US011324287B2

(12) United States Patent
Wang et al.

(10) Patent No.: US 11,324,287 B2
(45) Date of Patent: May 10, 2022

(54) DETACHABLE BELT BUCKLE

(71) Applicant: QING CAN XING HARDWARE CRAFTS CO., LTD., Quanzhou (CN)

(72) Inventors: Nianqing Wang, Quanzhou (CN); Jindang Wang, Quanzhou (CN)

(73) Assignee: QING CAN XING HARDWARE CRAFTS CO., LTD, Quanzhou (CN)

( * ) Notice: Subject to any disclaimer, the term of this patent is extended or adjusted under 35 U.S.C. 154(b) by 0 days.

(21) Appl. No.: 16/870,911

(22) Filed: May 9, 2020

(65) Prior Publication Data

US 2021/0076783 A1 Mar. 18, 2021

(30) Foreign Application Priority Data

Sep. 18, 2019 (CN) ..... 201921552356.0

(51) Int. Cl.
*A44B 11/25* (2006.01)
*A44B 11/06* (2006.01)
*A44B 11/00* (2006.01)

(52) U.S. Cl.
CPC ..... *A44B 11/06* (2013.01); *A44B 11/006* (2013.01)

(58) Field of Classification Search
CPC ..... A44B 11/06; A44B 11/006
See application file for complete search history.

(56) References Cited

U.S. PATENT DOCUMENTS 1,737,246 A * 11/1929 Jones ..... A44C 5/2047 24/616
4,161,806 A * 7/1979 Hennisse ..... A41F 1/006 24/586.11
4,217,681 A * 8/1980 Grohoski ..... A44C 5/14 224/164
4,281,440 A * 8/1981 Britz ..... A44B 11/006 24/163 FC
4,406,043 A * 9/1983 Friedman ..... A44B 11/006 24/171
4,825,515 A * 5/1989 Wolterstorff, Jr. ... A44B 11/263 24/196
5,191,685 A * 3/1993 Aoki ..... A44C 5/2052 24/265 WS
5,485,659 A * 1/1996 Kashikie ..... A44C 5/2052 24/71 J
5,787,554 A * 8/1998 Hashimoto ..... A44C 5/185 24/265 WS
5,806,148 A * 9/1998 McFalls ..... A44B 11/2561 24/168
6,389,653 B1 * 5/2002 Matoba ..... A44B 11/006 24/265 AL (Continued)

*Primary Examiner* — Jason W San

(57) ABSTRACT

The present disclosure provides a detachable buckle, including a belt head, a tail clamp, a fixing base, buckle buttons. One end of the fixing base is a hollow slot, the one end of the fixing base is connected with the tail clamp, and at least one socket is disposed on the one end of the fixing base. An opening is disposed on an edge of the hollow slot. Sliding grooves are disposed on both ends of the tail clamp, and the one end of the tail clamp is near the fixing base. Insert blocks sliding along the sliding grooves are disposed inside the sliding grooves. The insert blocks are connected with the buckle buttons, the buckle buttons drive the insert blocks to enter the hollow slot of the fixing base by pushing the tail clamp, and the buckle buttons are fixed with the sockets.

12 Claims, 6 Drawing Sheets

(56) References Cited

U.S. PATENT DOCUMENTS

| | | | | |
|---|---|---|---|---|
| 7,480,967 | B2 * | 1/2009 | Kojoori | A44B 11/006 2/322 |
| 8,056,191 | B2 * | 11/2011 | Crye | A44B 11/10 24/197 |
| 9,173,454 | B2 * | 11/2015 | Liu | A44B 11/006 |
| 9,591,899 | B2 * | 3/2017 | Catanese | A44C 5/246 |
| 9,930,936 | B2 * | 4/2018 | Liu | A44B 11/006 |
| 2012/0248793 | A1 * | 10/2012 | Fiedler | A44B 11/2592 292/163 |
| 2014/0215766 | A1 * | 8/2014 | Liu | A44B 11/006 24/188 |
| 2014/0298630 | A1 * | 10/2014 | Hortnagl | A44B 11/2519 24/697.2 |
| 2016/0000191 | A1 * | 1/2016 | Haider | A44B 11/2592 24/186 |
| 2016/0374436 | A1 * | 12/2016 | Park | A44B 11/25 24/615 |
| 2018/0289113 | A1 * | 10/2018 | Chu | A44B 11/266 |
| 2020/0022463 | A1 * | 1/2020 | Templeton | A44B 11/2592 |
| 2020/0085149 | A1 * | 3/2020 | Soung | A41F 9/025 |
| 2020/0352285 | A1 * | 11/2020 | Wang | A44B 11/24 |

* cited by examiner

DETACHABLE BELT BUCKLE

BACKGROUND

The present disclosure relates to a technical field of belt accessories, in particular to a detachable belt buckle.

TECHNICAL FIELD

Belts are developed by minorities of north ancient China in long-term life practice, which is not only used for tying gowns, but also used for hanging some objects for production and living. With development of science and technology, styles of the belts become diverse. A high-quality belt has become a symbol of identity, and a unique belt buckle further catches human's eyes.

In the prior art, a tail clamp of a belt buckle is connected with a fixed pivot fixed on the belt buckle, which cannot be detached. However, in this free era, consumers want to make their own belts, and replacing the belt head can only be done by replacing the tail clamp or the belt together with the belt head, which cannot achieve a result of self-matching. Dealers can only replace and sell the belt buckle as a whole, which cannot meet the consumers' consumption concept and is not conducive to improving the market competition capability of products.

In addition, the belt buckle in the prior art is generally disposed on a mounting groove of a buckle body by means of pressing rivet, and the buckle body has undergone surface treatment before been pressed rivet, thus, pressing rivet may damage the a surface of the buckle body. Meanwhile, after pressing rivet, the tail clamp and a fixing base cannot be detachable, so that the belt buckle is scrapped, which not only affects production efficiency, but also increases production cost, and is not conducive to development of enterprises.

SUMMARY

An object of the present disclosure is to provide a detachable belt buckle.

In order to achieve above object, the present disclosure provides the detachable belt buckle, including a belt head, a tail clamp, a fixing base, buckle buttons. One end of the fixing base is a hollow slot, the one end of the fixing base is connected with the tail clamp, and at least one socket is disposed on the one end of the fixing base. An opening is disposed on an edge of the hollow slot. Sliding grooves are disposed on both ends of the tail clamp, and the one end of the tail clamp is near the fixing base. Insert blocks sliding along the sliding grooves are disposed inside the sliding grooves. The insert blocks are connected with the buckle buttons, the buckle buttons drive the insert blocks to enter the hollow slot of the fixing base by pushing the tail clamp, and the buckle buttons are fixed with the sockets, so that the tail clamp is connected with the fixing base. The buckle buttons are separated from the sockets by pressing the buckle buttons, so that the tail clamp is separated from the fixing base.

Furthermore, the tail clamp includes a position-limit mechanism, wherein the position-limit mechanism is disposed on the tail clamp and connected with the insert blocks, the position-limit mechanism is configured to limit a moving distance of the insert blocks in the sliding grooves.

Furthermore, the position-limit mechanism includes screws and limit holes. The screws are screwed into the limit holes. Strip-shaped holes are disposed on the insert blocks, the screws pass through the limit holes and connect with the strip-shaped holes disposed on the insert blocks, the screws move relative to the strip-shaped holes along a length direction of the strip-shaped holes.

Furthermore, the insert blocks and the buckle buttons are integrally formed, right angle notches are disposed on one side of the insert blocks, and another side of the insert blocks is connected with the buckle buttons.

Furthermore, the buckle buttons further include springs, one end of the springs is disposed on the sliding grooves, and another end of the springs abuts against the insert blocks.

Furthermore, the sliding grooves further include receiving grooves, and the receiving grooves limit a compression scope of the springs.

Furthermore, the receiving grooves are formed by the right angle notches, a side wall of the insert blocks and an inner wall of the sliding grooves, the springs are received in the right angle notches.

Furthermore, the buckle buttons have an arc pressing surface.

Furthermore, two sockets are disposed on two opposite ends of the hollow slot; the number of the buckle buttons is two and the number of the insert blocks is two. The two buckle buttons are symmetrically disposed on both sides of the sliding grooves, and the two insert blocks are symmetrically disposed on both sides of the sliding grooves.

Furthermore, the present disclosure provides a belt, including a belt body and the detachable belt buckle. The detachable belt buckle is connected with the belt body.

Based on above, and compared with the prior art, the present disclosure provides provides the detachable belt buckle, including a belt head, a tail clamp, a fixing base, buckle buttons. One end of the fixing base is a hollow slot, the one end of the fixing base is connected with the tail clamp, and at least one socket is disposed on the one end of the fixing base. An opening is disposed on an edge of the hollow slot. Sliding grooves are disposed on both ends of the tail clamp, and the one end of the tail clamp is near the fixing base. Insert blocks sliding along the sliding grooves are disposed inside the sliding grooves. The insert blocks are connected with the buckle buttons, and the buckle buttons drive the insert blocks to enter the hollow slot of the fixing base by pushing the tail clamp, and the buckle buttons are fixed with the sockets, so that the tail clamp is connected with the fixing base. The buckle buttons are separated from the sockets by pressing the buckle buttons, so that the tail clamp is separated from the fixing base.

The present disclosure provides the detachable belt buckle, which connects the fixing base with the tail clamp by means of a buckle. Manufacturing of the present disclosure is simply, so that production efficiency is improved, cost is greatly reduced, and it is convenient and quick for users to use. Moreover, due to a fact that the detachable belt buckle is double-sided usable, resources are saved and purchase cost is reduced.

DETAILED DESCRIPTION

The technical solution in the present disclosure is clearly and completely described below in connection with accompanying drawings of embodiments of the present disclosure. Obviously, the described embodiments are merely parts of the present disclosure and not all embodiments. Based on the embodiments of the present disclosure, those of ordinary skill in the art who obtain other all embodiments without making any inventive faculty, fall within the scope of the present invention.

It is to be noted that terms "includes", "including", as well as any variations thereof, are intended to cover a non-exclusive inclusion. For example, a process, method, system, product, or apparatus which includes a listed steps or units should be not limited by the listed steps or units, but may include other steps or units not expressly listed or inherent to such process, method, article, or apparatus.

Figure 1:
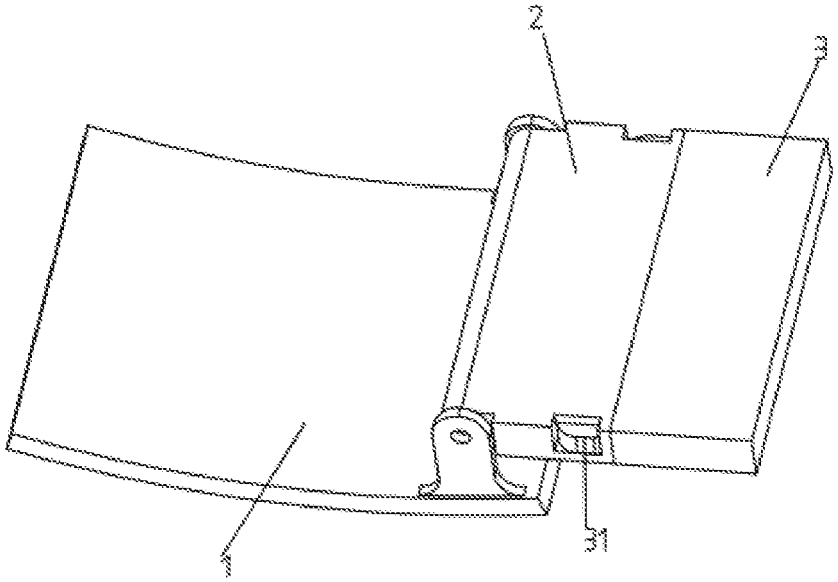
FIG. 1 is an overall schematic diagram of a detachable belt buckle according to the present disclosure.
Figure 2:
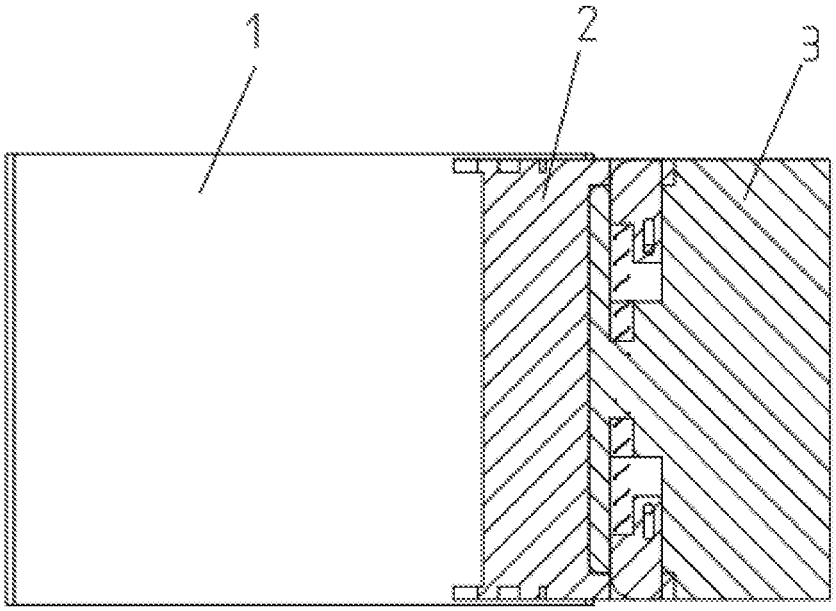
FIG. 2 is a top cross sectional schematic diagram of a detachable belt buckle according to the present disclose.
Figure 3:
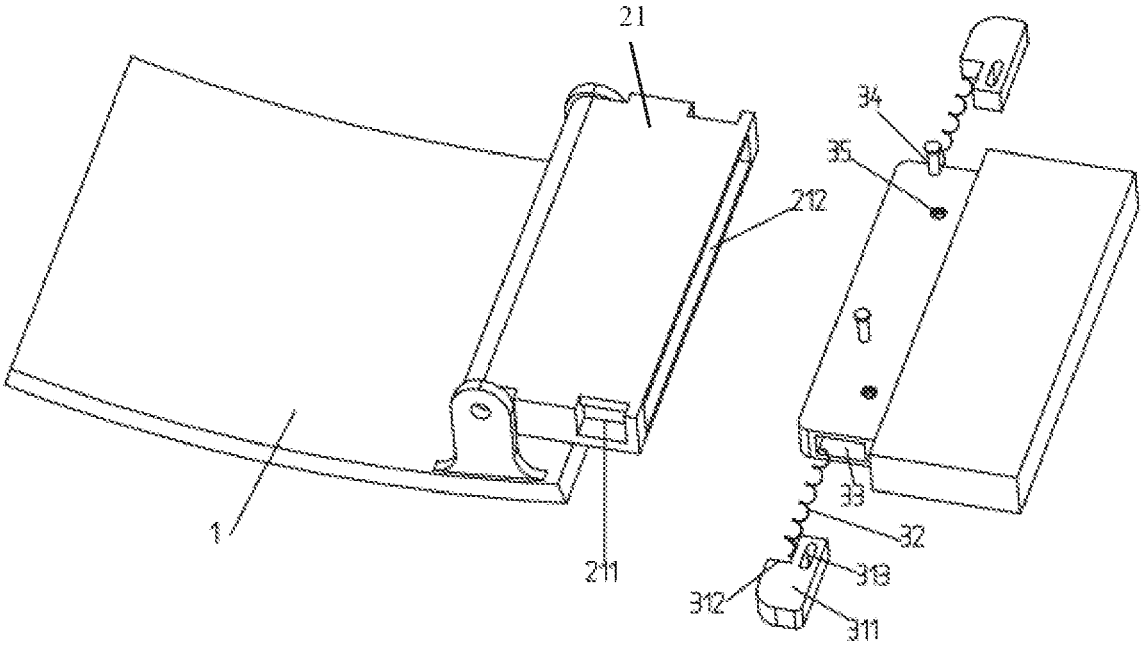
FIG. 3 is an exploded schematic diagram of a detachable belt buckle according to the present disclosure.
Figure 4:
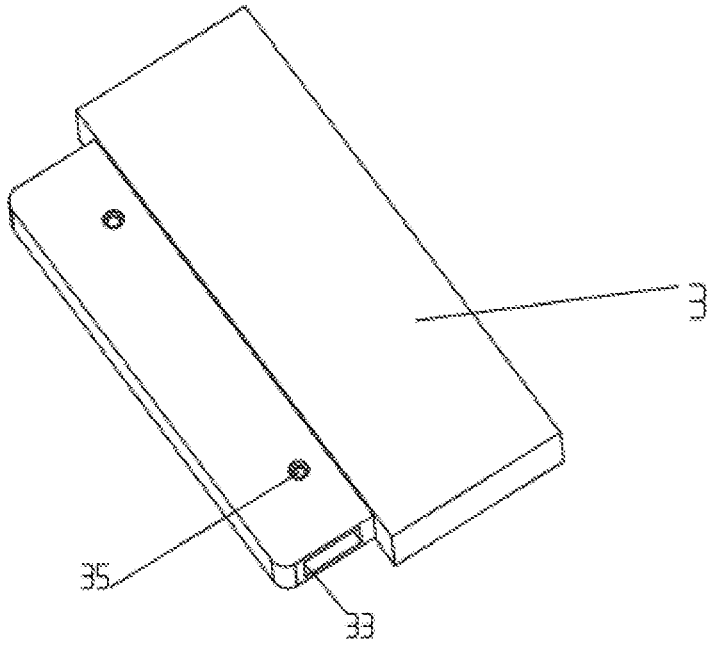
FIG. 4 is a schematic diagram of a tail clamp of a detachable belt buckle according to the present disclosure.
Figure 5:
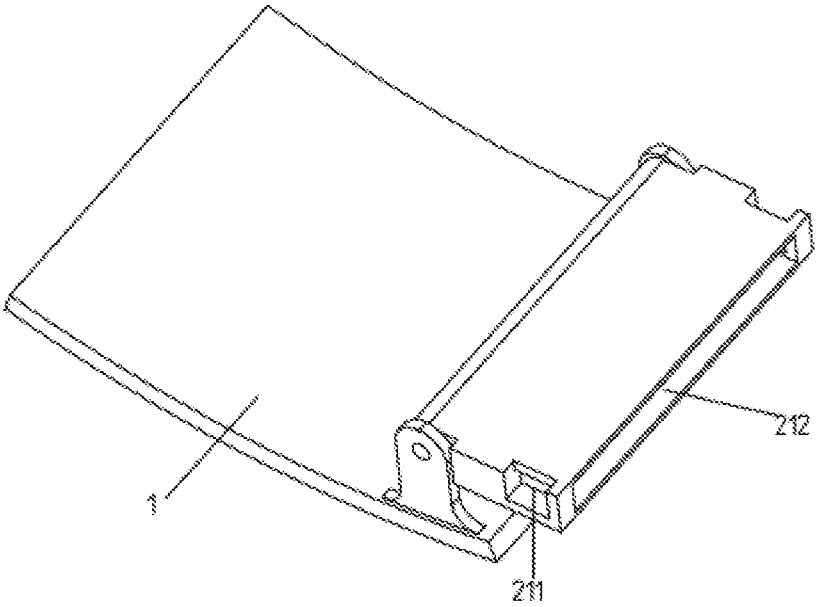
FIG. 5 is a schematic diagram of a fixing base of a detachable belt buckle according to the present disclosure.
Figure 6:
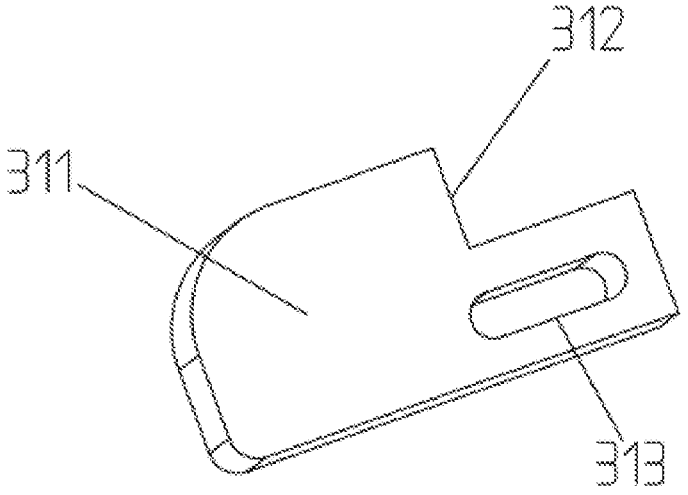
FIG. 6 is a schematic diagram of an insert block of a detachable belt buckle according to the present disclosure.

As shown in FIGS. 1-6, the present disclosure provides including a belt head 1, a tail clamp 3, a fixing base 2, buckle buttons 311. One end of the fixing base 2 is a hollow slot 21, the one end of the fixing base 2 is connected with the tail clamp 3, and at least one socket 211 is disposed on the one end of the fixing base 2. An opening 212 is disposed on an edge of the hollow slot 21. Sliding grooves 33 are disposed on both ends of the tail clamp, and the one end of the tail clamp is near the fixing base 2. Insert blocks 31 sliding along the sliding grooves 33 are disposed inside the sliding grooves 33. The insert blocks 31 are connected with the buckle buttons 311, and the buckle buttons 311 drive the insert blocks 31 to enter the hollow slot 21 of the fixing base 2 by pushing the tail clamp 3, and the buckle buttons 311 are fixed with the sockets 211, so that the tail clamp 3 is connected with the fixing base 2. The buckle buttons 311 are separated from the sockets 211 by pressing the buckle buttons (311, so that the tail clamp 3 is separated from the fixing base 2. The tail clamp 3 and the fixing base 2 are stably connected without complex welding processes by means of a buckle, and the tail clamp 3 and the fixing base 2 are convenient and quick to be detached, so that a service life of the tail clamp 3 and a service life of the fixing base 2 are prolonged.

The tail clamp 3 includes the insert blocks 31, the sliding grooves 33, a position-limit mechanism, and the buckle buttons 311. The position-limit mechanism is disposed on the tail clamp 3 and connected with the insert blocks 31. The position-limit mechanism is configured to limit a moving distance of the insert blocks 31 in the sliding grooves 33. The position-limit mechanism includes screws 34 and limit holes 35, the screws 34 are screwed into the limit holes. Strip-shaped holes 313 are disposed on the insert blocks 31, the screws 34 pass through the limit holes 35 and connect with the strip-shaped holes 313 disposed on the insert blocks 31, the screws 34 move relative to the strip-shaped holes 313 along a length direction of the strip-shaped holes 313. The insert blocks 31 and the buckle buttons 311 are integrally formed, right angle notches 312 are disposed on one side of the insert blocks 31, and another side of the insert blocks 31 is connected with the buckle buttons 311. The buckle buttons 311 further include springs 32, one end of the springs is disposed on the sliding grooves 33, and another end of the springs 32 abuts against the insert blocks 31. When the tail clamp 3 is pushed into the hollow slot 21 of the fixing base 2 and not reaches the sockets 211, the insert blocks 31 are subjected to a force, which deforms the springs 32, so that the insert blocks 31 are fully inserted into the sliding grooves 33. The sliding grooves 33 further include receiving grooves, and the receiving grooves limit a compression scope of the springs 32. The receiving grooves are formed by the right angle notches 312, a side wall of the insert blocks 31 and an inner wall of the sliding grooves 33, the springs 32 are received in the right angle notches 312. When the tail clamp is pushed to the notches 211, the insert blocks 31 are subjected to a reaction force of the springs 32, and then the insert blocks 31 are snap-in connected with the sockets 211. One end of the fixing base 2 is the hollow slot 21, the opening 212 is disposed on the edge of the hollow slot 21 which is near the tail clamp 3, and another end of the fixing base 2 is a closed solid structure. Two sockets 211 are disposed on two opposite ends of the hollow slot 21. The number of the buckle buttons 311 is two and the number of the insert blocks 31 is two. The two buckle buttons 311 are symmetrically disposed on both sides of the sliding grooves 33, and the two insert blocks 31 are symmetrically disposed on both sides of the sliding grooves 33. When the tail clamp 3 is pushed into the fixing base 2, a buckle portion of the tail clamp 3 is completely accommodated in the hollow slot 21, which achieves a locking effect, so that the belt buckle is hard to fall off and separate.

The present disclosure further provides a belt, including a belt body and the detachable belt buckle. The belt body is connected with the detachable belt buckle.

The working principle of the present disclosure is as follows:

During a process of using the detachable belt buckle, when the tail clamp 3 in inserted into the fixing base 2 and not reaches the sockets 211, the springs 32 are pressed by the insert blocks 31, and the insert blocks 31 are completely accommodated in the sliding grooves 33. When the tail clamp 3 reaches the sockets 211, the springs 32 spring back to an original position, the insert blocks 31 are also brought out the sliding grooves 33, and the insert blocks 31 are snap-in connected with the sockets 211, which makes the buckle portion of the tail clamp 3 are fixed inside the fixing base 2. When the detachable belt buckle is to be detached, the two insert blocks 31 are pressed to be brought out from the tail clamp 3, so that the tail clamp 3 is separated from the fixing base 2.

Based on above, compared with the prior art, the present disclosure provides the detachable belt buckle, which connects and detaches the tail clamp 3 and the fixing base 2 by snap-in connecting the insert blocks 31 of the tail clamp 3 with the sockets 211 of the fixing base 2. So that manufacturing cost of the belt buckle is greatly reduced, a manufacturing process of the belt buckle is simple, and users can quickly connect and detach the belt buckle.

While the foregoing is a description of several embodiments of the present disclosure, concepts of the present disclosure are not limited thereto. It is intended that the present disclosure not be limited to the particular embodiment disclosed, but on the contrary, the intention is to cover all such modifications as fall within the scope of the present disclosure.

What is claimed is:

1. A detachable belt buckle, comprising a belt head, a tail clamp, a fixing base, buckle buttons; wherein one end of the fixing base that is connected to the tail clamp defines a hollow slot, and two notches are defined in the end of the fixing base; an insert opening is defined in face of the hollow slot configured to receive the tail clamp; two sliding grooves are respectively defined in both sides of the tail clamp adjacent to the fixing base; an insert block is disposed in each of the two sliding grooves and is operative to linearly slide along a corresponding sliding groove; each insert block is connected with a buckle button configured to drive each insert block to enter the hollow slot of the fixing base by pushing the tail clamp, and each buckle button is operative to be pushed into a corresponding notch by an elastic force to be the interlocked with the notch, so that the tail clamp is connected with the fixing base; wherein each buckle button is also operative to be separated from the corresponding notch by pressing each buckle button to slide inwards in a corresponding sliding groove, so that the tail clamp is separated from the fixing base;

wherein the two notches are spaced apart from a plane of the insert opening, and are in communication with the insert opening;

wherein the tail clamp comprises position-limiters, which are disposed in the tail clamp; each of the position-limiters is connected with a corresponding insert block, each of the position-limiters is configured to limit a moving distance of the corresponding insert block;

wherein the position-limiters comprise screws and limit holes defined in the tail clamp, wherein the screws are screwed into the limit holes; each of the strip-shaped holes is defined in each insert block, each of the screws passes through a corresponding limit hole and connects with a corresponding strip-shaped hole defined in each insert block, the screws are operative to move relative to the strip-shaped holes along a length direction of the strip-shaped holes to limit a sliding distance of each insert block in each of the two sliding grooves, wherein the screws are fixed relative to the limit holes.

2. The detachable belt buckle according to claim 1, wherein each insert block and a corresponding buckle button are integrally formed; a right angle notch is defined in one side of each insert block; another side of each insert block is connected with the corresponding buckle button.

3. The detachable belt buckle according to claim 1 wherein each buckle button comprises a spring; a first end of each spring is disposed on a corresponding sliding groove; a second end of each spring abuts against a corresponding insert block.

4. The detachable belt buckle according to claim 3, wherein the two sliding grooves further comprise receiving grooves, and each of the receiving grooves is operative to limit a compression scope of each spring.

5. The detachable belt buckle according to claim 4, wherein each of the receiving groove is formed by a corresponding right angle notch, a side wall of a corresponding insert block, and an inner wall of a corresponding sliding groove; each spring is received in a corresponding right angle notch.

6. The detachable belt buckle according to claim 1, wherein each buckle button has an arc pressing surface.

7. The detachable belt buckle according to claim 1, wherein two notches are disposed on two opposite ends of the hollow slot; the number of the buckle buttons is two and the number of the insert blocks is two; the two buckle buttons are symmetrically disposed on both sides of the two sliding grooves, and the two insert blocks are symmetrically disposed on both sides of the two sliding grooves.

8. A belt, comprising a belt body and the detachable belt buckle as recited in claim 1, wherein the detachable belt buckle is connected with the belt body.

9. The detachable belt buckle according to claim 1, wherein each of the screws is fixed relative to a corresponding limit hole each insert block is configured to slide relative to a corresponding screw; each of the screws is configured to move relative to a corresponding strip-shaped hole.

10. The detachable belt buckle according to claim 9, wherein the length direction of each of the strip-shaped holes is collinear with each other and further runs parallel to a longitudinal axis of each of the two sliding grooves.

11. The detachable belt buckle according to claim 1, wherein a longitudinal axis of each of the two sliding grooves is collinear with each other.

12. The detachable belt buckle according to claim 3, wherein each buckle button is arranged in each of the two sliding grooves; each spring is a linear compression spring; wherein two springs are provided; a longitudinal axis of a first spring arranged is collinear with a longitudinal axis of a second spring.

* * * * *